US005806435A

United States Patent [19]

Pitchford

[11] Patent Number: 5,806,435

[45] Date of Patent: Sep. 15, 1998

[54] SIDE BEARINGS FOR TRUCK BOLSTERS

[75] Inventor: Terry L. Pitchford, St. Louis, Mo.

[73] Assignee: AMSTED Industries Incorporated, Chicago, Ill.

[21] Appl. No.: 709,389

[22] Filed: Sep. 6, 1996

[51] Int. Cl.[6] ..... B61F 5/00

[52] U.S. Cl. ..... 105/199.3

[58] Field of Search ..... 105/199.1, 199.3, 105/199.4, 453

[56] References Cited

U.S. PATENT DOCUMENTS

| | | | |
|---|---|---|---|
| 1,202,808 | 10/1916 | Crosti | 105/199.4 |
| 1,810,718 | 6/1931 | Lord | 105/199.3 |
| 2,169,616 | 8/1939 | Rice | 105/453 |
| 2,576,367 | 11/1951 | Spearman | 105/199.3 |
| 3,416,463 | 12/1968 | Flowers | 105/453 |
| 3,601,063 | 8/1971 | Dean | 105/199.3 |
| 3,748,001 | 7/1973 | Neumann et al. | 105/199.3 |
| 3,897,737 | 8/1975 | Davis | 105/199 CB |
| 3,913,495 | 10/1975 | Pelabon | 105/199.3 |
| 3,941,061 | 3/1976 | Schindehutte et al. | 105/199.3 |
| 3,981,548 | 9/1976 | MacDonnell et al. | 105/199.3 |
| 4,130,066 | 12/1978 | Mulcahy | 105/199 CB |
| 4,434,720 | 3/1984 | Mulcahy et al. | 105/199 CB |
| 5,036,774 | 8/1991 | Curtis et al. | 105/199.3 |
| 5,086,707 | 2/1992 | Spencer et al. | 105/199.3 |
| 5,138,954 | 8/1992 | Mulcahy | 105/199.3 |

FOREIGN PATENT DOCUMENTS

| | | | |
|---|---|---|---|
| 3-14762 | 1/1991 | Japan | 105/453 |

OTHER PUBLICATIONS

Miner Side Bearing Selection Chart TecsPak Alloy Constant Contact Side Bearings (no date).

Miner—W.H. Miner Division TCC, TCC–II, TCC–III Side Bearing Selection Chart (no date).

*Primary Examiner*—Mark T. Le

*Attorney, Agent, or Firm*—Edward J. Brosius; F. S. Gregorczyk; Stephen J. Manich

[57] ABSTRACT

A constant contact spring bearing for use with a railway car truck bolster is provided. Greater design flexibility and installation tolerances are available because a longer travel spring, with potentially lower spring load rate and stress rate, may be used. The present invention facilitates the establishment of loadings that may be expected to fall reliably within set-up tolerances from unit to unit. Instead of mounting the spring bearing on the surface of the truck bolster top member, the present invention provides a recess in the truck bolster to receive the spring, allowing for use of longer springs. With longer travel springs available for use, a spring may be selected with a lower load rate and a lower stress rate.

36 Claims, 4 Drawing Sheets

SIDE BEARINGS FOR TRUCK BOLSTERS

FIELD OF THE INVENTION

The present invention relates to side bearings for truck bolsters, and more particularly, to improved constant contact type side bearings mountable on a truck bolster to contact the underside of a railcar body.

BACKGROUND OF THE INVENTION

The usual freight railcar comprises a car body supported on at least one, and usually two, wheeled trucks that are confined to roll on rails. Each truck includes a truck bolster that extends essentially transversely of the car body longitudinal center line and pivotally supports the car body. In the preponderance of freight cars in domestic use, the pivotal connection is made by center bearing plates and center plate bowls transversely centered on the car body underframe and the truck bolster. Accordingly, the truck may turn or pivot on the center plate under the car body and, under certain dynamic conditions and car speeds during operation, the truck may tend to adversely oscillate or "hunt" in a yaw-like manner beneath the car body. Also, the car body is subject to adversely roll from side to side during operation. Side bearings positioned on the truck bolster outwardly of the center plate bowl are commonly employed to control both such adverse conditions by frictionally retarding oscillations and cushioning and limiting the extent of the rolling motions.

Constant contact type side bearings usually include a base that is fastened to the top of the bolster and a cap that is biased upward from the base so as to contact bearing pads on the car body underframe. The cap must be free to move vertically with respect to the base, and during the course of operation, the clearance between those parts will be enlarged due to abrasion and wear. Various examples of prior art side bearings are provided in the art, including: U.S. Pat. No. 3,748,001 (1973) to Neumann et al.; U.S. Pat. No. 3,897,737 (1975) to Davis; and U.S. Pat. No. 4,130,066 (1978) to Mulcahy.

Other side bearing structures are shown, for example, in U.S. Pat. No. 4,434,720 (1984) to Mulcahy et al. and in U.S. Pat. No. 5,138,954 (1992) to Mulcahy.

Various structures have been suggested for use as side bearings. Prior art side bearings have frequently used coil springs mounted on the upper surface of a top member of a truck bolster. The coil springs used in the prior art side bearings have had a relatively large spring rate, that is, the load per unit deflection, to support the weight of the car. With such high spring rates, great care was necessary in installation of the springs, or the two side bearings could exert an uneven load on the bottom of the railcar, putting the railcar out of balance. For example, if a bearing spring with a spring rate of 4,000 pounds per inch (lb/in) was used, a variation in placement of the bearings that deflected one spring one tenth of an inch more than the other spring would result in 400 pounds of additional force being exerted on one side of the car than on the other side. Accordingly, it was necessary to ensure that both springs were properly deflected at rest to assure balanced loading of the railcar by the springs. Thus, the prior art presents problems of a low tolerance for error in placement of the side bearings, as well as the problem of non-uniform or unbalanced loading of the railcar if the side bearings fell outside of those close tolerances.

In addition, many of the springs used in the prior art side bearings have had a relatively high stress rate, so that at the loaded height of the spring, the spring was under significant stress, tending to fatigue the spring and decrease its useful life.

SUMMARY OF THE INVENTION

The present invention allows for greater flexibility in side bearing design, and in particular, greater flexibility in the choice of springs used in side bearings. It also allows for greater tolerances in the placement of side bearings without sacrificing uniform or balanced loading of the railcar body by the side bearings. The invention facilitates the establishment of loadings that may be expected to fall reliably within set-up tolerances from unit to unit. It also reduces the stress on the springs to improve the useful life of the bearing.

The present invention provides a constant contact side bearing that allows for use of a lower spring rate so that a difference between specified nominal set-up height and actual installed set-up height results in a smaller difference between desired and actual loading of the railcar by the springs. Lower stress rates may also be used to improve the useful life of the bearing. The present invention allows for use of springs with lower spring rates by increasing the lengths of the springs, and by providing a suitable housing for the longer travel springs without adding substantially to the structure of the truck bolster.

In one aspect, the present invention provides, in a railway truck of the type having a pair of side frames and a truck bolster extending between the side frames, wherein the truck bolster includes a top member, a bottom member spaced from the top member and an interior between the top member and the bottom member, the improvement wherein the truck bolster includes a spring supported within the interior of the truck bolster. The spring extends from an interior end in the interior of the truck bolster to an exterior end outside of the truck bolster.

In another aspect, the present invention provides a side bearing for use with a railway truck of the type having a pair of side frames and a truck bolster extending between the side frames for supporting a railroad car body. The side bearing comprises a housing support, a vertical member extending from one side of the housing support to an end, a spring support at the end of the vertical member and a spring. The spring has a lower end on the spring support and an upper end extending past the housing support.

In another aspect the present invention provides in a railway truck of the type having a pair of side frames and a truck bolster extending between the side frames, the improvement wherein the truck bolster comprises an apertured top member, a bottom member spaced from the top member, a pair of spring housings within the interior of the truck bolster. Each spring housing has an open upper end and includes a spring support within the interior of the truck bolster and aligned with the aperture of the top member of the bolster and a vertical member extending from the spring support to the top member of the truck bolster. The truck bolster also has a spring within each spring housing. Each spring has an interior end on the spring support within the interior of the truck bolster within the spring housing and an exterior end extending out of the aperture in the top member of the truck bolster. A bearing surface is on the exterior end of each of the springs for bearing against a portion of a railroad car body.

In another aspect the present invention provides in a railway truck of the type having a pair of side frames and a truck bolster extending between the side frames, the improvement wherein the truck bolster comprises a top member with a pair of recesses defining spring housings. Each recess includes a spring support and a vertical member extending between the spring support and the top member of the truck bolster. A spring is within each recess. Each spring has an interior end on the spring support and an exterior end extending beyond the top member of the truck bolster on the exterior of the truck bolster. A bearing surface is on the exterior end of the spring for contacting a portion of a railroad car body.

In another aspect the present invention provides in a railway truck of the type having a pair of side frames and a truck bolster extending between the side frames, wherein the truck bolster includes a top member, a bottom member spaced from the top member and an interior between the top member and the bottom member, the improvement wherein the truck bolster comprises a spring supported within the interior of the truck bolster. The spring extends from an interior end in the interior of the truck bolster to an exterior end. An end cap is on the exterior end of the spring. The end cap has a bearing surface outside of the truck bolster.

DETAILED DESCRIPTION

Figure 1:
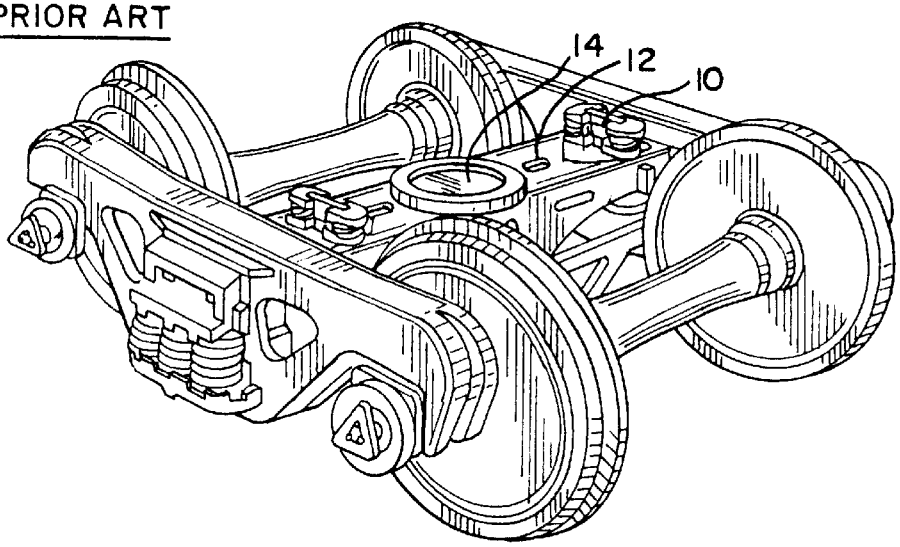
FIG. 1 PRIOR ART
FIG. 1 is a perspective view of a prior art railroad car truck with two side bearings on its bolster.
Figure 2:
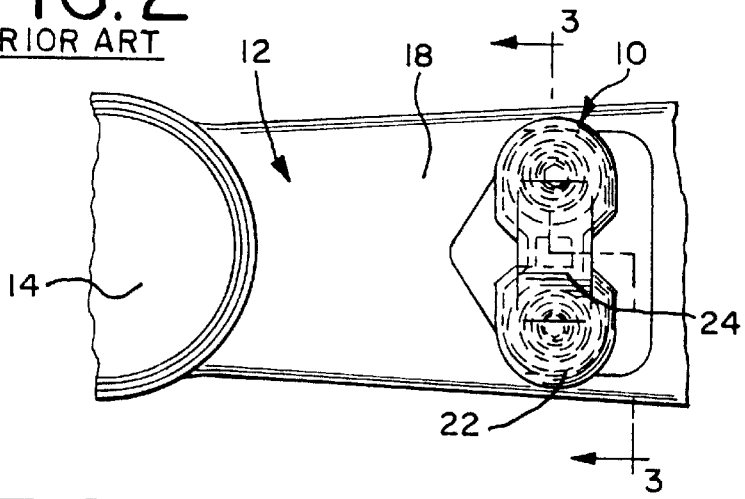
FIG. 2 PRIOR ART
FIG. 2 is a top plan view of a portion of the prior art truck bolster and side bearing of FIG. 1.
Figure 3:
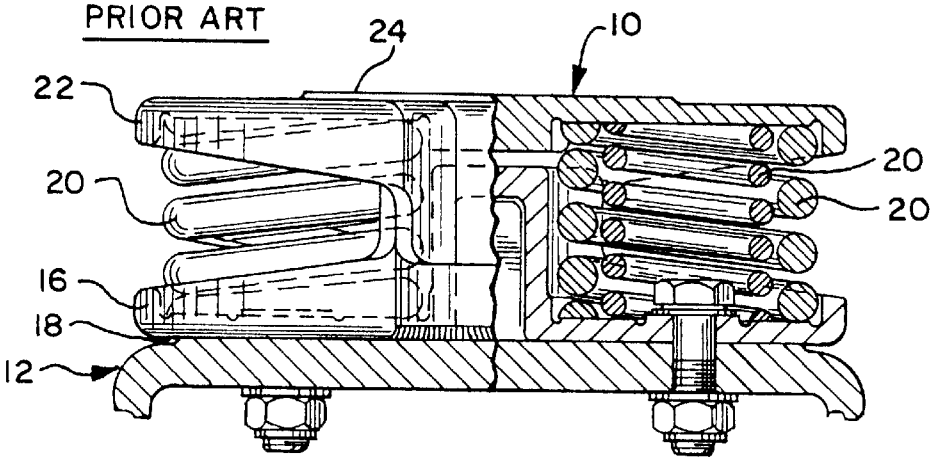
FIG. 3 PRIOR ART
FIG. 3 is a partial cross-section taken along line 3—3 of FIG. 2, showing part of the side bearing in cross section.

In FIGS. 1–3, a prior art side bearing, generally designated 10, is shown on a truck bolster, generally designated 12. Two such side bearings are provided on each truck bolster 10, spaced from and outboard from the center plate 14 of the truck bolster. Each such prior art side bearing generally includes a base housing 16 to be mounted by bolts, for example, on the top member 18 of the truck bolster 12. One or more springs 20 are mounted within the base housing 16, covered by an end cap 22. The cap and base are typically made of high tensile steel, and the cap is generally positioned to move vertically on the base. Typically, the end cap comprises a top bearing surface 24 that frictionally engages a bearing pad that is mounted on the underside of a car body part such as a body bolster (not shown).

Coil springs used in such prior art side bearings have been limited: the potential loaded length of the spring depends upon the distance between the top member 18 of the truck bolster 12 and the bearing pad of the railcar body to be supported; possible spring rates to provide the desired load or pre-load have also been limited by the types of springs available, and the types of springs available have been limited by the lengths of the springs. As illustrated in FIG. 3, each spring bearing may include more than one spring of different characteristics, to achieve proper loading of the railcar under different circumstances. The bearing shown in FIGS. 2–3 is described more fully in U.S. Pat. No. 4,130,066 (1978) issued to Mulcahy and assigned to Amsted Industries Incorporated. Other styles of bearings have been used in the prior art.

In the side bearing 100 of the present invention, illustrated in FIGS. 4–14, lower usable spring load and stress rates are achieved by increasing the lengths of the springs 102 that can be used while still supplying the desired load to the car body. To increase the length of the spring 102, a recess 104 is formed in the top member of the truck bolster, so that the spring is seated below the top member or compression member 106 of the truck bolster 108, within the interior 110 of the truck bolster.

Figure 4:
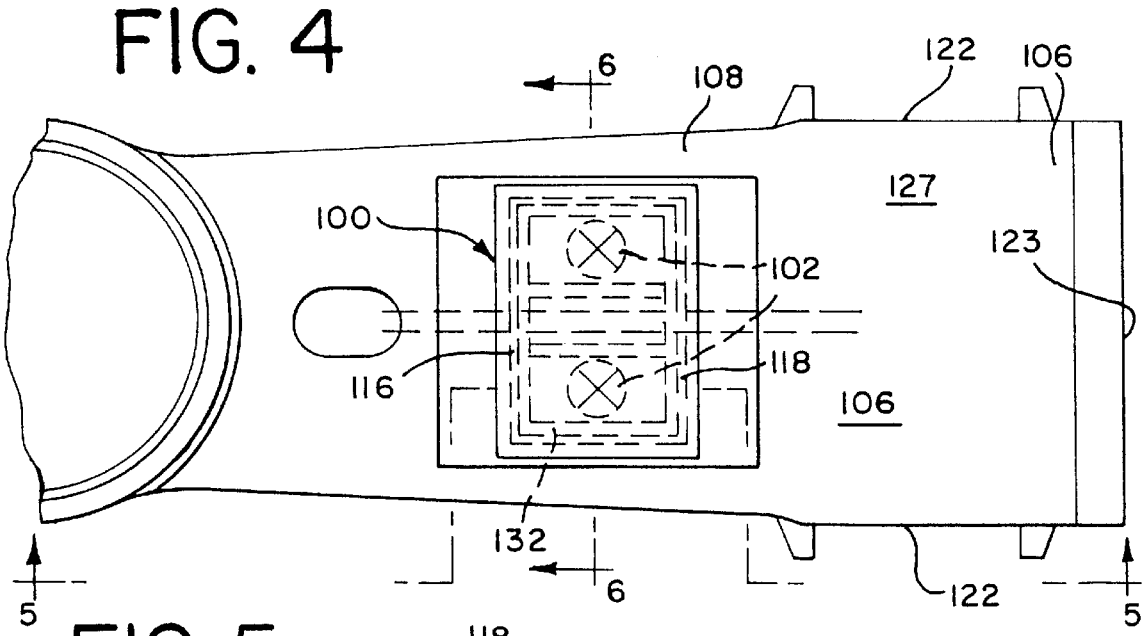
FIG. 4 is a top plan view of a portion of a truck bolster with a side bearing of the present invention.
Figure 5:
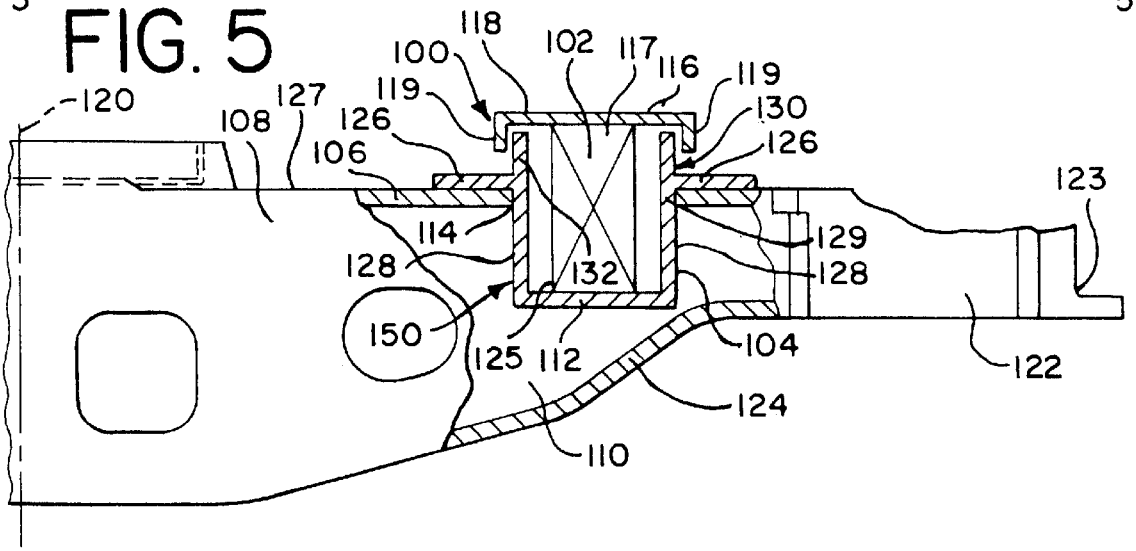
FIG. 5 is a cross-section taken along line 5—5 of FIG. 4.
Figure 6:
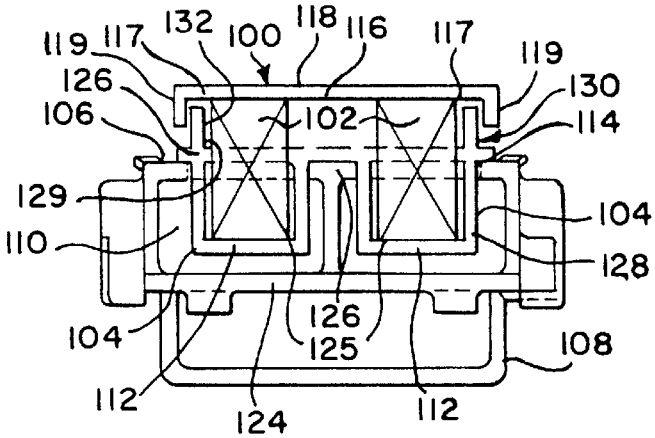
FIG. 6 is a cross-section taken along line 6—6 of FIG. 4.

In the first illustrated embodiment of FIGS. 4–6, two recesses 104 are formed in the truck bolster, each comprising an interior base or spring support 112, comprising a plate in the illustrated embodiments, within the interior 110 of the truck bolster. The top member 106 of the truck bolster 108 has a pair of rectangular apertures 114 vertically aligned with the interior base plates 112. The springs 102 may rest on the base spring support plates 112 and extend through the apertures 114 to the exterior of the bolster 108.

Figure 7:
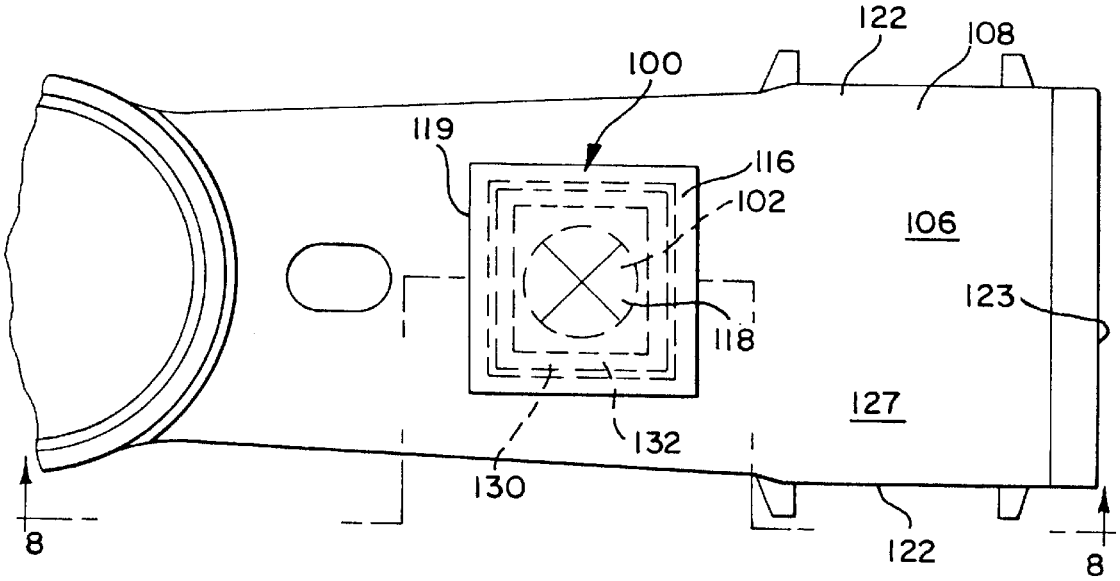
FIG. 7 is a top plan view of a portion of a truck bolster with another embodiment of the side bearing of the present invention.
Figure 8:
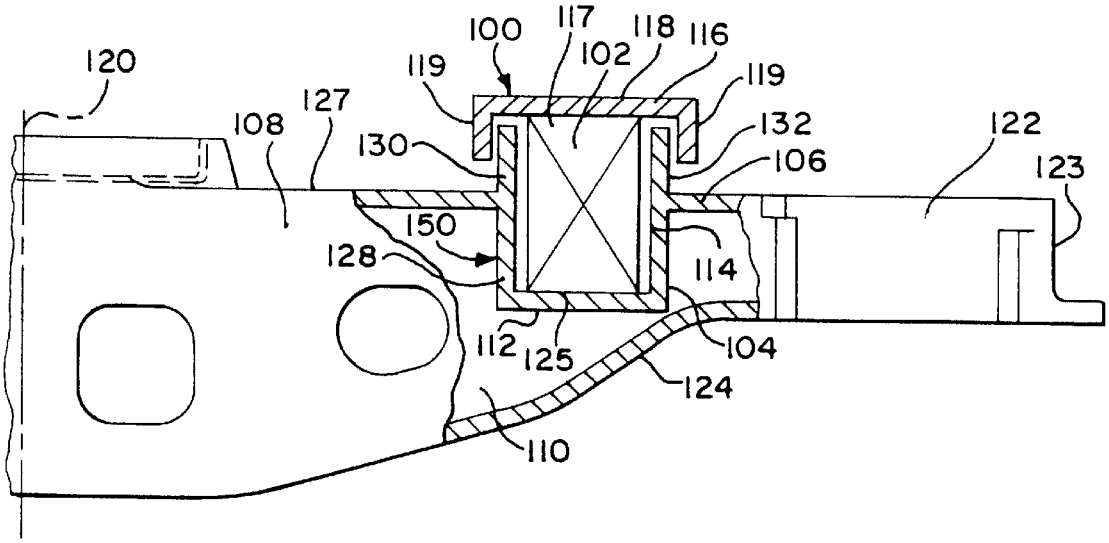
FIG. 8 is a cross-section taken along line 8—8 of FIG. 7.

In the first illustrated embodiment, each side bearing 100 has a pair of springs 102 sitting side by side on the support plates 112, with parallel axes of elongation. Each of the illustrated springs 102 is a coil spring, although it should be understood that other types of springs, such as elastomeric springs, may be used, are within the scope of the invention, and are included in the term "spring" as used in this patent. In addition, it should be understood that it is not necessary to use two side-by-side springs in each side bearing; a single spring could be used, as shown in FIGS. 7–8, or multiple springs could be used, in a side by side arrangement as shown in FIGS. 4–6, or in a co-axial arrangement as well (not shown).

On the exterior of the illustrated truck bolster 108, a single end cap 116 rests on the upper exterior ends 117 of the pair of springs 102 in each side bearing. Each illustrated end cap 116 has a top bearing surface 118 to frictionally engage the bearing pad on the underside of the railroad car body and side walls 119 extending downward from the top bearing surface 118. It should be understood that end caps as shown in the illustrated embodiments are not necessary, and that other forms of bearing surfaces may be used with the present invention. In the case of a polymer spring, for example, the upper surface of the polymer could be the bearing surface; alternatively, a metal bearing surface could be joined to a polymer spring.

In the illustrated embodiment, the side bearings 100 are located outboard of the center 120 of the truck bolster and inboard of the side frames and outboard ends 123 of the truck bolster 108 of the railway truck. As shown in FIGS. 4 and 7, the side frames would be mounted at the positions designated 122 inboard of the ends 123 of the bolster, in the manner shown in FIG. 1.

The interior base plates 112 may be positioned in the interior of the truck bolster, that is, the space between the top member 106 of the truck bolster 108 and its bottom or tension member 124. The bottom member 124 of the truck bolster may comprise the interior base plate or spring support 112. The interior base plates 112 provide interior support for the lower interior ends 125 of the springs 102, and any shape that will provide this support will suffice.

The interior base plates or spring supports 112 may be suspended from the top member 106 of the truck bolster 108 as shown in FIGS. 4–6. As there shown, in each side bearing of the first illustrated embodiment, a housing support plate 126 surrounds the rectangular aperture 114 and rests on the upper surface 127 of the top member 106 of the bolster 108. In the first illustrated embodiment, vertical members or walls 128 are integral with and depend downward from the inner opening 129 of the horizontal housing support plate 126 to the interior base plate 112.

Alternatively, the vertical members or walls 128 and interior base plate 112 could be cast as integral parts of the truck bolster without a separate annular plate, as shown in the embodiment of FIGS. 7–8, where like numbers have been used to indicate parts equivalent to those of the embodiment of FIGS. 4–6. In this embodiment, a single coil spring 102 is shown in the bearing.

On the upper surface 127 of the top member 106 of the bolster 108, the side bearings 100 may include exterior housings 130 extending upward from the bolster. These exterior housings 130 may comprise vertical sidewalls 132 that may be integral with the horizontal support plate 126, as shown in FIGS. 4–6, or that may be integral with the top member 106 of the bolster 108 as shown in FIGS. 7–8, or that may be separate annular housings secured to the top member 106 of the bolster 108 or to the horizontal support and the top member of the bolster by bolts or otherwise.

The exterior housing sidewalls 132 may be on the interior of the end cap 116 side walls 119, as shown in the embodiment of FIGS. 4–6, or on the exterior of the end cap 116 side walls 119 as shown in the embodiments of FIGS. 9–12. Alternatively, the side bearing may omit an exterior housing and the end cap 116 side walls 119 may extend into the interior of the recess 104, as shown in the embodiments of FIGS. 13–14. In the embodiments of FIGS. 9–14, the same numbers have been used for like parts as in the embodiments of FIGS. 4–8.

Figures 9, 10, 11, 12, 13, 14:
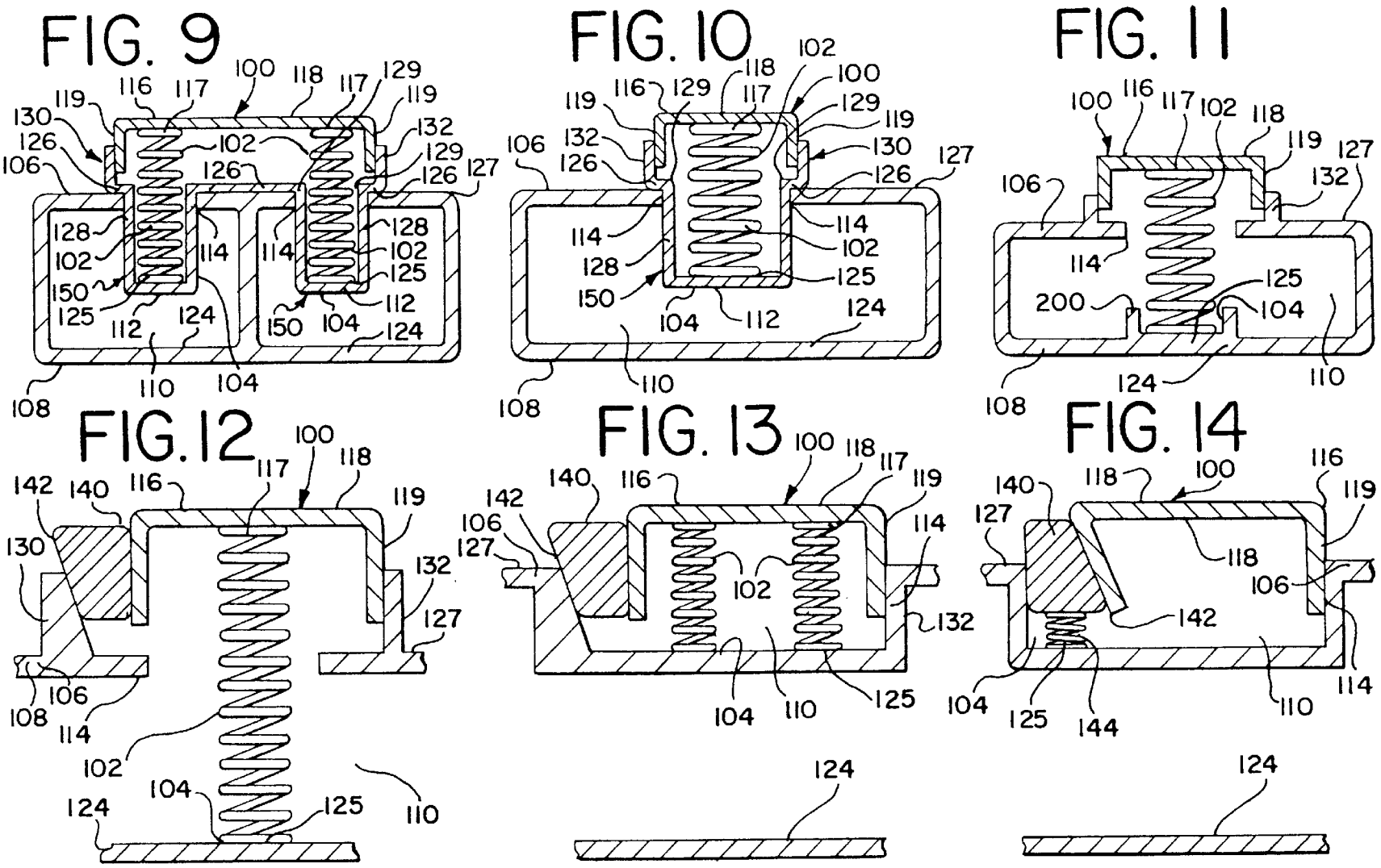
FIG. 9 is a cross-section of an alternative embodiment of a side bearing and portion of a truck bolster.
FIG. 10 is a cross-section of an alternative embodiment of a side bearing and portion of a truck bolster.
FIG. 11 is a cross-section of an alternative embodiment of a side bearing and portion of a truck bolster.
FIG. 12 is a cross-section of an alternative embodiment of a side bearing and truck bolster.
FIG. 13 is a cross-section of an alternative embodiment of a side bearing and truck bolster.
FIG. 14 is a cross-section of an alternative embodiment of a side bearing and truck bolster.

As shown in FIGS. 12–14, the side bearing may include means for limiting non-vertical movement of the end cap 116. For example, there may be a wedge 140 disposed between the sidewalls 119 of the end cap 116 and the sidewalls 132 of the exterior housing 130, with one or the other of the sidewalls 132, 119 sloped to match the sloped face 142 of the wedge 140. The side bearing may include biasing means 144, such as a coil spring, to push the wedge 140 upward as shown in the embodiment of FIG. 14, instead of or in addition to a spring acting on the end cap 116.

The wedge 140 in this instance is a self adjustable spacing member. As set forth in U.S. Pat. No. 5,086,707 issued in 1992 to Charles P. Spencer and Terry L. Pitchford entitled "Self Adjusting Constant Contact Side Bearing for Railcars", the entire disclosure of which is incorporated by reference herein, the vertical movement of the end cap with respect to the housing may cause the clearance between these elements to increase because of wear and abrasion. And pivotal movement of the truck beneath a car body will apply large frictional forces to the end cap in a generally longitudinal direction of the car body tending to wear the longitudinal ends of the cap and housing. As longitudinal wear occurs the cap becomes free to move longitudinally and thus, the ability to dampen oscillations (hunting) of the truck is reduced. Also, the longitudinal forces tend to cant or tilt the cap with respect to the base and that tendency increases as the clearance between the cap and base becomes enlarged through wear. When the cap becomes canted, the ability to dampen oscillations and cushion roll will be further hindered. This problem is addressed in the embodiments illustrated in FIGS. 12–14, wherein the wedge 140 acts as a shim to limit or prevent undesirable non-vertical movement between the end cap and the exterior housing. The illustrated wedges eliminate play between the end caps and the sidewalls, that is, they eliminate non-vertical movement in a generally longitudinal direction along the car body. It should be understood that other means for limiting non-vertical movement may also be employed, including all those disclosed in U.S. Pat. No. 5,086,707, for example. It may be desirable to construct devices similar to those described in that patent using ball bearings and grooves instead of rollers.

The depending vertical walls 128 and support plates 112 illustrated in FIGS. 4–10 define recessed spring housings 150, and it may not be necessary to provide such housings, or housings of the form shown in the illustrated embodiments. It should also be understood that it is not necessary that the vertical walls of such housings extend around the full perimeter of the support plate; the interior support plate could be suspended from its corners, for example. If the bottom member of the bolster is used as the interior support for the springs, it may not be necessary to include any housing for the spring, as shown in the embodiment of FIG. 12. Two springs 102 could also be provided to act against the end cap 116 without placing them in separate housings 150, as shown in the embodiment of FIG. 13. In using the bottom member of the bolster as the base for the spring, it may be desirable to provide some structure to limit lateral movement of the spring within the interior of the bolster, but such a lateral limit need not be in the form of vertical walls 128 or a housing 150 as shown in FIGS. 4–10. For example, as shown in the embodiment of FIG. 11, an annular positioning ring 200 could be used either on the bottom member 124 of the bolster or on an interior support plate (not shown), to surround the outer diameter of the bottom end 125 of the spring 102, or an upstanding element could extend through the interior of the spring (not shown); either structure would comprise a vertical member that limits lateral movement of the spring. In addition, the recessed spring housing 150 could be cylindrical, for example, if a single coil spring were used.

The benefits of the present invention may be seen from a comparison of the properties of commercially available types of springs. Comparing three springs made by American Steel Foundries of Hammond, Ind., designated as 11-1-05016, 11-1-05016-A, and 11-1-05016-B:

| | 11-1-05016 | 11-1-05016-A | 11-1-05016-B |
|---|---|---|---|
| Load Rate (lb/in) | 4193 | 2627 | 2262 |
| Stress Rate (psi/in) | 85615 | 50798 | 43175 |
| Free Height (in) | 5.410 | 8.000 | 8.000 |
| Solid | 3.880 | 5.500 | 6.200 |

-continued

| | 11-1-05016 | 11-1-05016-A | 11-1-05016-B |
|---|---|---|---|
| Height (in) | | | |
| Travel (in) | 1.530 | 2.500 | 1.800 |

Thus, for desired load of, for example, 4066 lbs. per spring, the calculated travel for each of the three springs would be 0.9697 inches, 1.5477 inches, and 1.797 inches, respectively and the calculated stresses at those deflections would be 83021.841 psi, 78623.777 psi, and 77608.111 psi, respectively. And while the prior art space limitations may not have permitted use of springs with a solid height as great as 5.5 or 6.2 inches, using the present invention allows for use of these springs, with their lower spring load rates and lower stress rates. With the lower spring load rates, there are greater tolerances in setting the bearings: an imbalance of 0.1 inch in height for a bearing with spring 11-1-05016, there would be a difference of 419 pounds of force, while that same imbalance with spring 11-1-05016-A would amount to a difference of 262 pounds of force. These springs and the values of their spring load and stress rates, free heights, solid heights and travel are given for purposes of illustration only, to demonstrate that use of a longer travel spring with a lower spring load and stress rate may be beneficial, and that the present invention offers the beneficial advantage of use of longer travel springs with lower spring load and stress rates.

In actual service, side bearings' load rates may be expected to range from about 500 lb./in. to about 10,000 lb./in. The current invention allows for a lower spring rate with a potentially higher ultimate capacity.

It may be desirable in some instances to use multiple springs, such as concentric springs with different characteristics, or springs of other construction, such as polymer springs or Bellville washers, for example, alone or in addition to or instead of coil springs. For a polymer spring, it may be desirable to fill the entire recess with the polymer to limit lateral movement.

The exterior housing 130 and end cap 116 may be made of the same materials as currently used in the art for side bearing end caps, such as hardened steel. The interior support 112 and vertical walls 128 may be also be made of steel of the same type used to make the bolster 108. The horizontal plate 126 or surface suspending the bearing may be welded to the bolster if desired.

While only specific embodiments of the invention have been described, it is apparent that various alternatives and modifications can be made thereto. Those skilled in the art will recognize that certain modifications can be made in these illustrative embodiments. It is, therefore, the intention in the appended claims to cover all such modifications and alternatives as may fall within the true scope of the invention.

I claim:

1. A railway truck having a pair of side frames, a separate truck bolster extending between he side frames, and a pair of resilient means for supporting the bolster on the side frames so that the bolster is vertically movable with respect to the side frames, wherein the truck bolster has a center midway between the side frames and includes a top member, a bottom member spaced from the top member, side members connecting the top member and bottom member, the top member, bottom member and side members having exterior surfaces, and the bolster having an interior between the exterior surfaces of said top member, side members and the bottom member, each resilient means having a lower end below the truck bolster, wherein the top member has a center midway between the side frames and first and second apertures positioned inboard of the side frames with the center of the top member between the first and second apertures, and wherein said truck bolster includes a first biasing means for contacting a portion of a railway car body and a second biasing means for contacting a portion of a railway car body, the first and second biasing means being supported within the interior of the truck bolster and positioned inboard of the side frames with the center of the truck bolster between the first and second biasing means, the first biasing means having an interior end in the interior of the truck bolster and an exterior end outside of the truck bolster, the second biasing means having an interior end in the interior of the truck bolster and an exterior end outside of the truck bolster, the first biasing means extending through the first aperture and the second biasing means extending through the second aperture, the bolster top member exterior surface having a portion at a first vertical level, the bolster top member including a non-vertical interior surface having a portion at a vertical level between the first vertical level and the interior ends of the first and second biasing means.

2. The railway truck of claim 1 wherein said first biasing means includes a first exterior bearing member at the exterior end of said first biasing means for bearing against a portion of a railway car body and a first spring means in contact with said first exterior bearing member for urging said first exterior bearing member into contact with a portion of the railway car body, and wherein said second biasing means includes a second exterior bearing member at the exterior end of said second biasing means for bearing against a portion of a railway car body and a second spring means in contact with said second exterior bearing member for urging said second exterior bearing member into contact with a portion of the railway car body.

3. The railway truck of claim 1 further comprising first and second vertical members in the interior of the truck bolster, said first vertical member positioned to limit lateral movement of said first biasing means said second vertical member positioned to limit lateral movement of said second biasing means.

4. The railway truck of claim 1 further comprising first and second supports within the interior of the bolster, the interior end of said first biasing means being supported on said first support and the interior end of said second biasing means being supported on said second support.

5. The railway truck of claim 1 wherein said interior end of said first biasing means contacts said bottom member of said bolster and said interior end of said second biasing means contacts said bottom member of said bolster.

6. The railway truck of claim 4 wherein each of said first and second supports is positioned between said top member and said bottom member in the interior of the truck bolster.

7. The railway truck of claim 1 further comprising first and second vertical walls, each vertical wall depending from said top member of said truck bolster, said first vertical wall substantially surrounding a part of said first biasing means and said second vertical wall substantially surrounding a part of said second biasing means.

8. The railway truck of claim 7 wherein each of said vertical walls is integral with said top member of the truck bolster.

9. The railway truck of claim 7 wherein said first biasing means includes a coil spring and said second biasing means includes a coil spring, the railway truck further comprising a first spring support within the interior of the truck bolster on which the first coil spring rests and a second spring support within the interior of the truck bolster on which the second coil spring rests, and wherein said first vertical wall is substantially perpendicular to the first spring support and said second vertical wall is substantially perpendicular to said second spring support.

10. The railway truck of claim 1 further comprising a first housing support resting on said exterior surface of the top member of said truck bolster, a first vertical member extending from said first housing support through said first aperture into the interior of the bolster, a first spring support within the interior of the bolster, the first housing support, first vertical member and first spring support being integral, the interior end of the first biasing means contacting the first spring support, a second housing support resting on said exterior surface of the top member of said truck bolster, a second vertical member extending from said second housing support through said second aperture into the interior of the bolster and a second spring support within the interior of the bolster, the second housing support, second vertical member and second spring support being integral, said second biasing means contacting said second spring support.

11. The railway truck of claim 1 wherein said first biasing means comprises a first end cap, a first spring and a first block, the first block bearing against the first end cap, and wherein said second biasing means comprises a second end cap, a second spring and second block, the second block bearing against the second end cap and the second spring bearing against the second block.

12. The railway truck of claim 2 wherein the first spring means comprises a coil spring that extends from the interior end to the first exterior bearing member and the second spring means comprises a coil spring that extends from the interior end to the second exterior bearing member.

13. In combination, first and second side bearings and a railway track having a pair of side frames and a separate truck bolster extending between the side frames for supporting a railway car body, the railway truck further including a pair of resilient means for supporting the bolster on the side frames so that the bolster is vertically movable on the resilient means with respect to the side frames, the truck bolster having a center midway between the side frames, the side bearings being positioned inboard of the side frames with the center of the truck bolster between the side bearings, the truck bolster having a top member with a first aperture at said first side bearing and a second aperture at said second side bearing, the track bolster top member having longitudinal edges on both sides of the first and second apertures and an exterior surface, the truck bolster including sidewalls extending downward from the longitudinal edges of the truck bolster top member, the truck bolster sidewalls having exterior surfaces and the truck bolster having an interior between the exterior surfaces of the top member and sidewalls, the first side bearing comprising:

a first spring support positioned in the interior of the truck bolster beneath the first aperture and at a level beneath the level of a part of the top member; and a first spring means for providing a force, the first spring means having a lower end on the first spring support and extending at least to said top member, the first spring means having a longitudinal axis aligned with the first aperture;

the second side bearing comprising:

a second spring support positioned beneath the second aperture in the interior of the bolster and at a level beneath the level of a part of the top member; and a second spring means for providing a force, the second spring means having a lower end on the second spring support and extending at least to said top member, the second spring means having a longitudinal axis aligned with the second aperture.

14. The combination of claim 13 further comprising a first end cap engaged by said first spring means and having a bearing surface outside of the truck bolster, wherein the force provided by said first spring means is for urging said first end cap bearing surface into contact with a portion of the railway car body, and a second end cap engaged by said second spring means and having a bearing surface outside of the truck bolster, wherein the force provided by said second spring means is for urging said second end cap bearing surface into contact with a portion of the railway car body.

15. The combination of claim 13 further comprising a first housing support positioned on said exterior surface of said top member, a first vertical member extending from said first housing support through said first aperture to said first spring support, a second housing support positioned on said exterior surface of said top member, and a second vertical member extending from said second housing support through said second aperture to said second spring support.

16. The combination of claim 13 further comprising first and second vertical members that are integral with said top member and extend from said top member into the interior of said truck bolster, the first vertical member contacting the first spring support and the second vertical member contacting the second spring support.

17. The combination of claim 13 wherein said first and second side bearings further comprise first and second exterior housings extending upward from the exterior surface of the top member of the truck bolster.

18. The combination of claim 13 wherein the first spring means extends through the first aperture and beyond the level of at least a part of the exterior surface of the truck bolster top member and the second spring means extends through the second aperture and beyond at least a part of the exterior surface of the truck bolster top member.

19. A railway truck having a pair of side frames, a separate truck bolster extending between the side frames, and a pair of resilient means for supporting the bolster on the side frames so that the bolster is vertically movable with respect to the side frames, the truck bolster having a first outboard end and a second outboard end and a center midway between the outboard ends, wherein said truck bolster comprises:

a top member having a center midway between the first and second outboard ends and longitudinal edges, a first aperture positioned between the longitudinal edges, a second aperture positioned between the longitudinal edges, the first and second apertures being positioned inboard of the side frames with the center of the top member between the first and second apertures;

a bottom member spaced from said top member and having a first end portion at said first outboard end and a second end portion at said second outboard end, the first and second end portions being spaced from the top member at a first distance, the bottom member having a central portion at said bolster center spaced from the top member at a second distance, the second distance being greater than the first distance, the bottom member including a first intermediate portion between the central portion and the first end portion and a second intermediate portion between the central portion and the second end portion, the first intermediate portion converging toward the top member from the central portion to the first end portion and the second intermediate portion converging toward the top member from the central portion to the second end portion;

the top member and the bottom member having exterior surfaces and the truck bolster having an interior between the exterior surfaces of the top member and bottom member, the exterior surface of the top member being at a level above the bottom member;

a first bearing surface exterior to said truck bolster top member and aligned with said first aperture;

a second bearing surface exterior to said truck bolster top member and aligned with said second aperture:

a first spring support within the interior of the truck bolster and aligned with the first aperture of said top member of said bolster, the first spring support being substantially parallel to a part of said top member of said truck bolster;

a second spring support within the interior of the truck bolster and aligned with the second aperture of said top member of said bolster, the second spring support being substantially parallel to a part of said top member of said truck bolster;

a first spring means for urging said first bearing surface away from the interior of the bolster, said first spring means having an interior end on said first spring support within the interior of said truck bolster and extending at least to said top member of said truck bolster; and a second spring means for urging said second bearing surface away from the interior of the bolster, said second spring means having an interior end on said second spring support within the interior of said truck bolster and extending at least to said top member of said truck bolster;

the first spring means having a longitudinal axis intersecting the first aperture and the first intermediate portion of the bottom member, and the second spring means having a longitudinal axis intersecting the second aperture and the second intermediate portion of the bottom member.

20. The railway truck of claim 19 further comprising a first housing support plate on the exterior surface of the top member of said bolster, a first vertical member extending from said first housing support plate through said first aperture to first spring support, said first housing support plate being integral with said first vertical member and said first spring support, a second housing support plate on the exterior surface of the top member of said bolster, a second vertical member extending from said second housing support plate through said second aperture to second spring support, said second housing support plate being integral with said second vertical member and said second spring support.

21. The railway truck of claim 19 wherein said first spring means extends from the first spring support through the first aperture and includes a portion above the level of at least a part of the exterior surface of the top member and the second spring means extends from the second spring support through the second aperture and includes a portion above the level of at least a part of the exterior surface of the top member, the truck bolster further comprising first and second exterior housings, the first exterior housing being above the level of at least a part of the exterior surface of the top member and surrounding the first aperture and the portion of said first spring means above the level of at least a part of the exterior surface of the top member, the second exterior housing being above the level of at least a part of the exterior surface of the top member and surrounding the second aperture and the portion of said second spring means above the level of at least a part of the exterior surface of the top member.

22. The railway truck of claim 20 wherein said first spring means extends beyond the exterior surface of the top member of the truck bolster, the truck bolster further comprising a first exterior housing surrounding the portion of said first spring means outside of said truck bolster, and wherein said second spring means extends beyond the exterior surface of the top member of the truck bolster, the truck bolster further comprising a second exterior housing surrounding the portion of said second spring means outside of said truck bolster.

23. The railway truck of claim 19 further comprising a first vertical member extending substantially perpendicularly from the first spring support to the top member and a second vertical member extending substantially perpendicularly from the second spring support to the top member, and wherein said first and second vertical members are integral with said top member of said truck bolster.

24. The railway truck of claim 19 further comprising a first vertical member extending substantially perpendicularly from the first spring support to the top member and a second vertical member extending substantially perpendicularly from the second spring support to the top member, and wherein said first vertical member comprises a wall substantially surrounding the first spring means and said second vertical member comprises a wall substantially surrounding the second spring means.

25. The railway truck of claim 19 wherein the first spring means extends through the first aperture and beyond the at least a part of the exterior surface of the top member of the bolster and the second spring means extends through the second aperture and beyond at least a part of the exterior surface of the top member of the bolster.

26. A railway truck having a pair of side frames, a separate truck bolster extending between the side frames, and a pair of resilient means for supporting the bolster on the side frames so that the bolster is vertically movable with respect to the side frames, wherein said truck bolster comprises:

an inboard end, an outboard end and a center midway between the inboard and outboard ends;

a top member having a center midway between the outboard end and inboard end and first and second recesses defining first and second interior spring housings, the first interior spring housing including a first spring support and a first vertical member extending between the first spring support and the top member of the truck bolster, the second interior spring housing including a second spring support and a second vertical member extending between the second spring support and the top member of the truck bolster, the first and second interior spring housings being positioned inboard of the side frames and at least a part of each resilient means with the center of the bolster between the first and second interior spring housings, the top member having portions at a level above the level of the first spring support and second spring support;

a first bearing surface at a level above the level of a portion of the top member and aligned with said first interior spring housing;

a first spring means for urging said first bearing surface upward, the first spring means including a portion within the first interior spring housing, the first spring means having an interior end on the first spring support and an upper end extending above the level of at least a part of the top member of the truck bolster;

a second bearing surface at a level above the level of a portion of the top member and aligned with said second interior spring housing;

a second spring means for urging said second bearing surface upward, said second spring means including a portion within the second interior spring housing, the second spring means having an interior end on the second spring support and an upper end extending above the level of at least a part of the top member of the truck bolster, and a pair of spaced bolster sidewalls on both sides of the top member, the spaced bolster sidewalls having exterior surfaces and the bolster having an interior between the exterior surfaces of the bolster sidewalls, the first and second spring supports being positioned in the bolster interior.

27. The railway truck of claim 26 wherein said first vertical member comprises a wall substantially surrounding said first spring means and said second vertical member comprises a wall substantially surrounding said second spring means.

28. A railway truck for supporting a railway car body, the railway truck having a pair of side frames, a separate truck bolster extending laterally between the side frames, and a pair of resilient means for supporting the bolster on the side frames so that the bolster is vertically movable with respect to the side frames, wherein the truck bolster includes a top member, a bottom member spaced from the top member, a pair of sidewalls between the top member and bottom member, the top member, sidewalls and bottom member having exterior surfaces, the truck bolster having a first outboard end, a second outboard end, a central vertical plane midway between the first outboard end and the second outboard end, and an interior between the exterior surfaces of the top member, sidewalls and the bottom member, wherein the exterior surface of the top member has parts at a level above the bottom member, and the bottom member has a first end portion at the first outboard end and a second end portion at the second outboard end and a central portion at the central vertical plane of the bolster, the first and second end portions being spaced from the top member at a first distance and the central portion of the bottom member being spaced from the top member at a second distance, the second distance being greater than the first distance, and the bottom member includes a first intermediate portion between the central portion and the first end portion and a second intermediate portion between the central portion and the second end portion, and wherein the top member has a first aperture and a second aperture, the first and second apertures being spaced apart with the central vertical plane being between the first and second apertures, and wherein said truck bolster comprises a first biasing means for contacting a portion of a railway car body and including a first coil spring having an interior end within the interior of the truck bolster, the first biasing means extending through the first aperture of the top member and having an upper end above the level of at least a part of the exterior surface of the top member of the truck bolster, and a second biasing means for contacting a portion of a railway car body and including a second coil spring having an interior end within the interior of the bolster, the second biasing means extending through the second aperture of the top member, the second biasing means having an upper end above the level of at least a part of the exterior surface of the top member of the truck bolster, the first and second biasing means being spaced laterally from the pair of resilient means, the bolster further including a first exterior housing extending upwardly from the exterior surface of the top member of the bolster and substantially surrounding the first aperture, and a second exterior housing extending upwardly from the exterior surface of the top member of the bolster and substantially surrounding the second aperture, the first and second exterior housings having interiors free from any part of the railway car body.

29. The railway truck of claim 28 further comprising first and second vertical members, the first vertical member being positioned to limit lateral movement of the first biasing means and the second vertical member being positioned to limit lateral movement of the coil spring of the second biasing means.

30. The railway truck of claim 28 further comprising first and second supports for said first and second biasing means within the interior of the truck bolster, the first support contacting the interior end of said first biasing means and the second spring support contacting the interior end of said second biasing means.

31. The railway truck of claim 28 wherein said interior end of said first coil spring contacts said bottom member of said bolster and said interior end of said second coil spring contacts said bottom member of said bolster.

32. The railway truck of claim 30 wherein each of said first and second supports for said first and second biasing means is positioned between said top member and said bottom member in the interior of the truck bolster.

33. The railway truck of claim 28 further comprising first and second vertical walls depending from said top member of said truck bolster, said first vertical wall substantially surrounding said first biasing means and said second vertical wall substantially surrounding said second biasing means.

34. The railway truck of claim 33 wherein said first and second vertical walls are integral with said top member of the truck bolster.

35. The railway truck of claim 33 further comprising first and second supports in the interior of the truck bolster, and wherein said first vertical wall is connected to said first support and said second vertical wall is connected to said second support.

36. The railway truck of claim 28 wherein said first biasing means includes a first end cap on the exterior of the bolster and in contact with the first coil spring, and the second biasing means includes a second end cap on the exterior of the bolster and in contact with the second coil spring.

* * * * *

UNITED STATES PATENT AND TRADEMARK OFFICE

CERTIFICATE OF CORRECTION

PATENT NO. : 5,806,435

DATED : September 15, 1998

INVENTOR(S) : Terry L. Pitchford

It is certified that error appears in the above-identified patent and that said Letters Patent is hereby corrected as shown below:

In claim 1, line 2 (column 7, line 58), "he" should read --the--.

In claim 13, line 2 (column 9, line 36), "track" should read --truck--.

In claim 13, line 13 (column 9, line 47), "track" should read --truck--.

In claim 26, line 42 (column 13, line 7), the "," should be a --;--.

Signed and Sealed this

Twenty-eighth Day of December, 1999

*Attest:*

Q. TODD DICKINSON

*Attesting Officer*

*Acting Commissioner of Patents and Trademarks*